United States Patent [19]

Pribnow

[11] Patent Number: 4,717,150

[45] Date of Patent: Jan. 5, 1988

[54] DIVING BOARD BASKETBALL HOOP

[76] Inventor: Roger J. Pribnow, 8821 61st Ave. N., New Hope, Minn. 55428

[21] Appl. No.: 896,614

[22] Filed: Aug. 13, 1986

[51] Int. Cl.[4] ..... A63B 63/08

[52] U.S. Cl. ..... 273/1.5 R

[58] Field of Search ..... 273/1.5 R, 1.5 A, 411

[56] References Cited

U.S. PATENT DOCUMENTS

| | | | |
|---|---|---|---|
| 2,707,104 | 4/1955 | Killick | 273/1.5 R |
| 2,818,254 | 12/1957 | Dunn | 273/1.5 R |
| 3,108,803 | 10/1963 | Naideth | 273/1.5 |
| 3,194,555 | 7/1965 | Humphrey | 273/1.5 |
| 3,414,262 | 12/1968 | Lounsbury | 273/1.5 |
| 3,469,844 | 9/1969 | Sindelar | 273/105 |
| 3,477,714 | 11/1969 | Garlington | 273/1.5 |
| 3,743,286 | 7/1973 | Weinhagen | 273/1.5 |
| 4,220,337 | 9/1980 | Moore | 273/395 |
| 4,307,887 | 12/1981 | Weiss | 273/411 |

*Primary Examiner*—Paul E. Shapiro

*Attorney, Agent, or Firm*—Merchant, Gould, Smith, Edell, Welter & Schmidt

[57] ABSTRACT

A basketball backstop (1) which may be mounted adjacent to a swimming pool. The backstop is mounted on a first upright member (2) and a second upright member (3), the upright brackets having a horizontal and a vertical portion. The upright members slide over the end of the diving board (4) for a distance of approximately 18 inches, the diving board being gripped by a series of four parallel horizontal bars (5, 6, 7 and 8). The diving board is gripped between two pairs of horizontal bars, threaded fasteners urging the opposed bars toward each other, knobs (9, 10, 11 and 12) facilitating rotation of the threaded fasteners by hand.

9 Claims, 2 Drawing Figures

DIVING BOARD BASKETBALL HOOP

FIELD OF THE INVENTION

This invention relates to a basektball hoop mounting device, and in particular to a basketball hoop mounting device which may be placed on a diving board adjacent to a swimming pool such that the persons occupying the swimming pool may utilize the basketball hoop. The device may be quickly mounted to the diving board without any modification to the board itself, and similarly removed from the diving board at will.

DESCRIPTION OF RELATED TECHNOLOGY

There are a great many patents and other references dealing with the construction of basketball goals, swimming pool accessories and methods for removably mounting brackets to planar surfaces. The following devices are illustrative of basketball backstops mounted on planar surfaces, and game accessories mounted adjacent to swimming pools.

U.S. Pat. No. 3,108,803, issued to Naideth, discloses a basketball goal set mounted on a gently sloping roof. A pair of triangular truss elements are used to fasten a vertical backstop 27 to the roof 13. Although the backstop is adjustable through a series of adjustment holes 51, the backstop itself is permanently mounted to the roof via fasteners 49.

U.S. Pat. No. 3,194,555, issued to Humphrey, discloses a basketball goal of conventional construction. Note that the hoop 10 is fastened to a vertical surface by means of a right angle bracket 12. No mechanism is disclosed for removably mounting bracket 12 to a horizontal planar surface.

U.S. Pat. No. 3,414,262, issued to Lounsbury, discloses an adjustable basketball backboard bracket. This bracket can be mounted to a planar surface, including a horizontal planar surface. Mounting is achieved by means of rods 15 which are permanently attached to the planar surface by fasteners 17. The invention resides primarily in the ability to adjust the angle of the backboard after permanent mounting has been accomplished.

U.S. Pat. No. 3,469,844, issued to Sindelar, discloses a basketball game for use in a swimming pool. In this device, an innertube 10 serves as the foundation for a basketball hoop 28 which is mounted to the innertube via a tripod 12 and bands 18. The innertube floats on the surface of the water, and, of course, is quite unstable in actual use.

U.S. Pat. No. 3,477,714, issued to Garlington, discloses a basketball hoop which moves horizontally at periodic intervals within a vertical backboard device. The backboard 1 is supported by rods 11 which may be pivoted around threaded fastener 12 to adjust the backboard to any convenient angle.

U.S. Pat. No. 3,743,286, issued to Weinhagen, discloses a basketball backstop designed for use at poolside. The horizontal backstop 12 is supported by a right angle tubular structures 32 and 20. In this particular embodiment, the device is held in place by means of weights 60.

U.S. Pat. No. 4,220,337, issued to Moore, discloses a game utilizing a backstop for use in a swimming pool. In this game, a ball 31 is thrown against backstop 11, the ball thereby bouncing back into the pool at some distance, the distance traveled determining the score. The backstop assembly 11 is mounted to the pool by means of angle bracket 16 with hooks 17 that fit over the edge 35 of the pool.

U.S. Pat. No. 4,307,887, issued to Weiss, discloses a basketball game for use with a pool. The backstop is mounted on a vertical pole 14 which is attached by means of brackets 20 to the side of the pool 34.

None of the cited patents employ a portable, easily removable basketball hoop mounting device which may be attached to a diving board, without damaging the diving board or interfering with the subsequent use of the diving board once the backstop is removed. Similarly, the cited patents are inherently unstable, or require a relatively massive special structure to brace and support the device in a permanent manner.

SUMMARY OF THE INVENTION

The present invention is designed to add to the enjoyment of backyard swimming pools. Many devices have been developed to enable occupants of the swimming pool to play various types of ball games, but the equipment involved is either unstable, insufficiently portable, or requires a substantial amount of installation effort. The present invention is a basketball backstop which may be temporarily mounted to an existing swimming pool diving board. The backstop is mounted on a right angle bracket, the vertical portion of the bracket supporting the backstop itself, and the horizontal portion of the bracket being adapted to being removably mounted at the end of a diving board. The bracket slides over the end of the diving board for a distance of approximately 18 inches, the diving board being gripped by a series of four parallel horizontal bars, each pair of bars gripping the diving board between them. Threaded fasteners are used to urge the opposed bars toward each other, the threaded fasteners having a knob mounted at one end to facilitate rotation by hand.

BRIEF DESCRIPTION OF THE DRAWINGS

The present description makes reference to the accompanying drawings wherein like reference numerals refer to like parts throughout the several views.

DESCRIPTION OF THE PREFERRED EMBODIMENT

Figure 1:
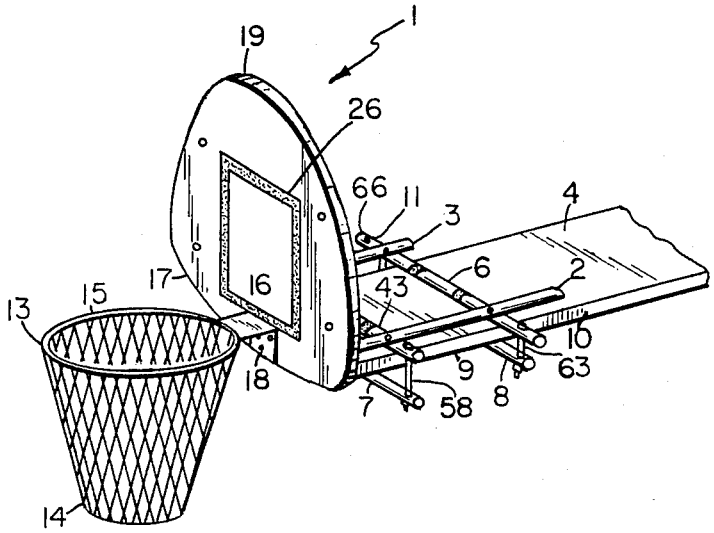
FIG. 1 illustrates the present invention in a perspective view as mounted on an existing diving board adjacent to a backyard swimming pool.

Referring to FIG. 1, a basketball hoop mounting device according to the present invention is shown generally at 1. A conventional basketball hoop 13 supports basketball net 14. The net may be attached to the hoop by any conventional method, such as by hooks built integrally within hoop 13, or, in the interest of safety, the preferred embodiment uses twelve small strips of tape 15 spaced evenly around the circumference of hoop 13, the tape using any suitable waterproof adhesive.

A mounting bracket 16 is formed integrally with hoop 13, the mounting bracket being formed to create a horizontal plane 17, which is coplanar with the plane of hoop 13, and a substantially vertical perpendicular plane 18, the vertical plane being used to attach the bracket 16 to backstop 19. The backstop 19 may be constructed of any suitable rigid material which does not deteriorate in the presence of water, the backstop having the generally semi-circular planform corresponding to the shape ganerally employed in an actual basketball game. The vertical segment 18 of mounting bracket 16 contains three mounting holes 20, 21 and 22, the holes being aligned in a generally triangular planform. Corresponding mounting holes 23, 24 and 25 are present in backstop 19 so as to prevent mounting by means of threaded fasteners (not shown), such as ¼ by ½ inch hex bolts secured in place by means of conventional T-nuts. The backstop 19 may be inscribed with a square 26 to assist in aiming the ball during actual play.

Figure 2:
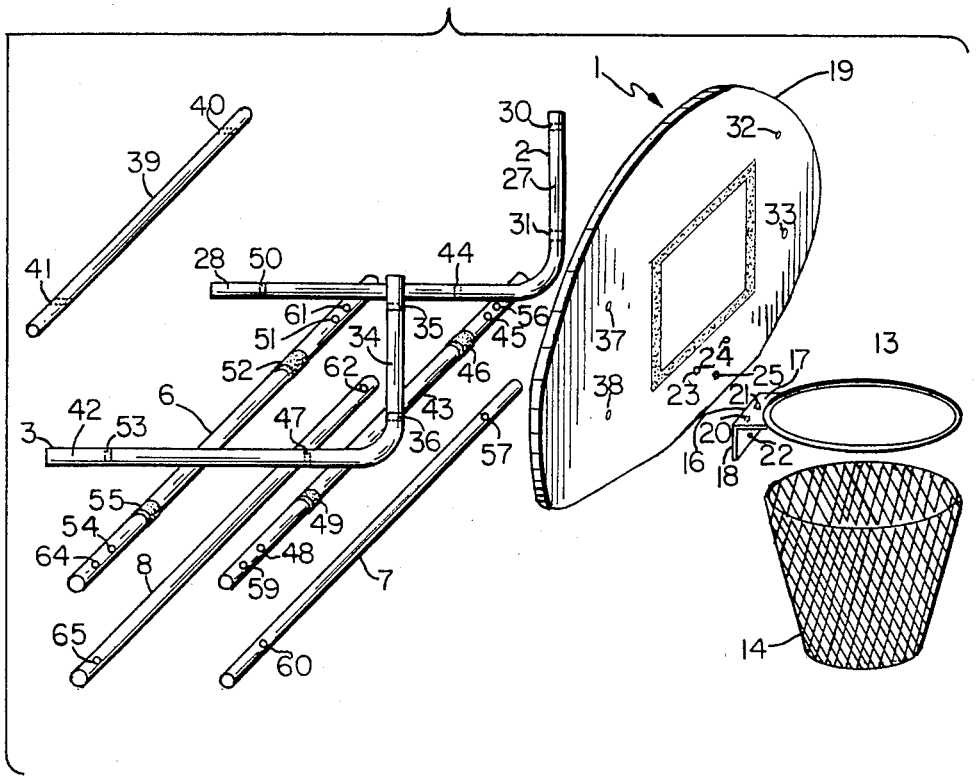
FIG. 2 is an expanded perspective view of the invention as depicted in FIG. 1.

As shown in FIG. 1, the basketball hoop mounting assembly 1 is affixed to a conventional diving board 4, as may be found adjacent to any swimming pool. As can be seen in FIGS. 1 and 2, the backstop 19 is supported in a vertical position by means of first upright member 2 and second upright member 3. The first and second upright members, 2 and 3 respectively, are substantially identical. In the preferred embodiment, the first upright member 2 is formed from some suitable tubular, metallic material, suitably coated with a paint or primer substance to resist corrosion in an aquatic environment. First upright member 2 is formed so as to have a vertical portion 27 and a horizontal portion 28, the two portions being joined integrally at radiused bend 29. The vertical portion 27 contains a top mounting hole 30 and a bottom mounting hole 31, the mounting holes passing diametrally through vertical portion 27 and corresponding to top mounting hole 32 and bottom mounting hole 33 on backboard 19. Any suitable fastener may be used to affix vertical portion 27 to backstop 19, and in the preferred embodiment two inch carriage bolts are employed. Similarly, second upright member 3 contains a vertical portion 34 in which has been machined top mounting hole 35 and bottom mounting hole 36, corresponding to top mounting hole 37 and bottom mounting hole 38 in backstop 19.

For ease of handling mounting assembly 1, a handle 39 is provided. Handle 39 is a single, tubular member of slightly less length than the width of backstop 19. Mounting holes 40 and 41 pass diametrally through points near the opposing ends of handle 39. Mounting hole 41 is aligned with top mounting hole 30 of vertical member 27 and top mounting hole 32 on backstop 19. Similarly, mounting hole 41 is aligned with top mounting hole 35 of vertical portion 34 and mounting hole 37 of backstop 19. The carriage bolts used to mount the upright members to the backstop pass through mounting holes 40 and 41 and are secured in place be means of T-nuts (not shown). The handle 39 may be easily grasped since the handle is offset from the backstop by a distance equal to the width of the tubular material forming upright supports 2 and 3.

As best seen in FIG. 2, first upright 2 has a horizontal portion 28, while second upright member 3 has a corresponding horizontal portion 42. Horizontal portions 28 and 42 are mounted so as to be coplanar, with a first horizontal member 43 mounted in a plane parallel to, but slightly below, the plane defined by horizontal portions 28 and 42. Each of these planes is parallel to the plane defined by diving board 4. First horizontal member 43 is perpendicular to horizontal members 28 and 42. First horizontal mounting hole 44 passes diametrally through horizontal portion 28 of first upright member 2, and is aligned with inner mounting hole 45 of first horizontal member 43. In the preferred embodiment, a ½ inch hex bolt passes through mounting holes 44 and 45 and is secured with a T-nut (not shown). In order to protect the surface of diving board 4 from contact with either first horizontal member 43 or the fasteners passing through inner mounting hole 45, a rubber protective gripper 46 consisting of a hollow, cylindrical resilient material, is placed over first horizontal member 43 adjacent to mounting hole 45. The rubber protective gripper 46 helps provide frictional contact with the diving board 4 while raising first horizontal member 43 from the surface of diving board 4 a sufficient distance to allow clearance of any fasteners used to connect horizontal portion 28 to first horizontal member 43. Similarly, mounting hole 47 passes diametrally through horizontal portion 42 of second upright member 3, and is aligned with inner mounting hole 48 of first horizontal member 43. A threaded fastener (not shown) passes through a mounting hole 47 and 48, thereby securing second upright member 3 to first horizontal member 43. A rubber protective gripper 49, identical to protective gripper 46, is placed adjacent to inner mounting hole 48.

A second horizontal member 6 is mounted so as to be parallel with first horizontal member 43, second horizontal member 46 being offset so as to be at a relatively greater distance from backstop 19 than the first horizontal member 43. Rear mounting hole 50 passes diametrally though horizontal portion 28 of first upright member 2, and is aligned with inner mounting holes 51 of second horizontal member 6. A threaded fastener (not shown) such as a ½ inch hex bolt, passes through mounting holes 50 and 51 and is secured inplace by means of a T-nut. A rubber protective gripping element 52 is placed adjacent to inner mounting hole 51. A rear mounting hole 53 passes diametrally through horizontal portion 42 of second upright member 3, rear mounting hole 53 being aligned with inner mounting hole 54 of second horizontal member 6. A threaded fastener (not shown) passes through mounting holes 53 and 54 and is secured in place by means of a T-nut. A rubber protective gripper 55 is mounted adjacent to inner mounting hole 54.

A third horizontal member 7 is mounted parallel to first horizontal member 43, horizontal member 47 being placed beneath diving board 4. A first outer mounting hole 56 passes diametrally through a first end of first horizontal member 43, mounting hole 56 being aligned with mounting hole 57, mounting hole 57 passing diametrally through a first end region of third horizontal member 7. A threaded fastener 58 passes through mounting holes 56 and 57, thereby urging first horizontal member 43 towards third horizontal member 7, thereby gripping diving board 4 beneath the two horizotal members. A knob 9 is attached to threaded fastener 58 to facilitate rotation of threaded fastener 58 by hand. Similarly, a mounting hole 59 passes diametrally through a second end region of first horizontally member 43, outer mounting hole 59 being aligned with mounting hole 60 which passes diametrally through a second end region of third horizontal member 7. A threaded fastener (not shown) passes through mounting holes 59 and 60, thereby urging first horizontal member 43 towards third horizontal member 7, thus gripping diving board 4 between the two horizontal members.

Finally, a fourth horizontal member 8 is mounted parallel to second horizontal member 6, fourth horizontal member 8 being mounted beneath diving board 4. A first outer mounting hole 61 passes diametrally through third horizontal member 6, mounting hole 61 being aligned with mounting hole 62, mounting hole 62 passing diametrally through a first end region of fourth horizontal member 8. Threaded fastener 63 passes through mounting hole 61 and 62, thereby urging fourth horizontal member 8 towards second horizontal member 6, thus gripping diving board 4 between the two respective horizontal members. A knob 10 facilitates rotation of threaded fastener 63 by hand. A second outer mounting hole 64 passes diametrally through a second end region of second horizontal member 6, mounting hole 64 being aligned with mounting hole 65, mounting hole 65 passing diametrally through a second end region of fourth horizontal member 8. A threaded fastener 66 passes through mounting hole 64 and 65, thereby urging second horizontal member 6 towards fourth horizontal member 8. A knob 11 facilitates rotation of threaded fastener 66 by hand.

Various changes in the size, shape and arrangement of parts may be made to the form of invention shown herein and described, without departing from the spirit of the invention or scope of the claims. For example, a single horizontal member could be placed beneath diving board 4, instead of third horizontal member 7 and fourth horizontal member 8, with threaded fasteners passing through the single horizontal bar to the already described first and second horizontal members.

I claim:

1. A basketball hoop mounting apparatus, comprising:

(a) a backstop;

(b) a bracket, the bracket having a first planar area and a second planar area, the first planar area being substantially perpendicular to the second planar area;

(c) first fastening means, the first fastening means rigidly affixing the bracket to the backstop such that the first planar area is substantially coplanar to the backstop;

(d) second fastening means, the second fastening means rigidly affixing the second planar area of the bracket to the basketball hoop;

(e) a net, the net being formed as a flexible cylindrical mesh permitting a spherical object to pass through the hoop and the net;

(f) an attachment assembly, the attachment assembly further comprising:

(i) a first upright member, the first upright member having a vertical portion and a horizontal portion, the horizontal portion having an end zone, the vertical portion being formed integrally with the horizontal portion by means of a radiused bend, the radiused bend occurring near a centrally located portion of the first member;

(ii) a second upright member, the second upright member having a vertical portion and a horizontal portion, the horizontal portion having an end zone, the vertical portion being formed integrally with the horizontal portion by means of a radiused bend, the radiused bend occurring near a centrally located portion of the first member;

(iii) a first horizontal member, the first horizontal member having a first end region and a second end region, the first end region being rigidly attached to the horizontal portion of the first upright member at a point adjacent to the radiused bend of the first upright member, the second end region being rigidly attached to the horizontal portion of the second upright member at a point adjacent to the radiused bend of the second upright member;

(iv) a second horizontal member, the second horizontal member having a first end region and a second end region, the first end region being rigidly attached to the horizontal portion of the first upright member at a point residing within the end zone of the horizontal portion of the first upright member, the second end being rigidly attached to the horizontal portion of the second upright member at a point residing within the end zone of the horizonal portion of the second upright member;

(v) a third horizontal member, the third horizontal member residing in a first plane, the first plane being defined as a place containing both the first horizontal member and the third horizontal member, a substantially planar diving board being interspersed between the first horizontal member and the third horizontal member, the third horizontal member being urged toward the first horizontal member such that the diving board is gripped between the first horizontal member and the third horizontal member.

2. The basketball hoop mounting apparatus of claim 1, further comprising a fourth horizontal member, the fourth horizontal member residing in a second plane, the second plane being defined as a plane containing both the second horizontal member and the fourth horizontal member, the substantially planar diving board being interspersed between the second horizontal member and the fourth horizontal member, the second horizontal member being urged toward the fourth horizontal member such that the diving board is gripped between the second horizontal member and the fourth horizontal member.

3. The basketball hoop mounting apparatus of claim 2, wherein the first plane as defined by the first horizontal member and the third horizontal member is substantially vertical, such that the interspersed diving board is substantially perpendicular to the first plane.

4. The basketball hoop mounting apparatus of claim 3, wherein the second plane, as defined by the second horizontal member and the fourth horizontal member is substantially vertical, such that the interspersed diving board is substantially perpendicular to the second plane.

5. The basketball hoop mounting apparatus of claim 4, wherein the first upright member is of a substantially circular cross-section, the first upright member being perforated by a plurality of diametrally aligned orficies, or orifices permitting shafted fasteners to pass through the first upright member, thereby facilitating rigid sequential attachment of the first upright member to the backstop, the first horizontal member, and the second horizontal member.

6. The basketball hoop mounting apparatus of claim 5, wherein the second upright member is of a substantially circular cross-section, the second upright member being perforated by a plurality of diametrally aligned orifices, the orifices permitting shafted fasteners to pass through the second upright member, thereby facilitating rigid sequential attachment of the second upright member to the backstop, the first horizontal member, and the second horizontal member.

7. The basketball hoop mounting apparatus of claim 6, wherein each end region of the first and second horizontal members contains a plurality of diametrally aligned mounting holes, thereby permitting shafted fasteners to pass through the first and second horizontal members and thereby mate with corresponding holes in the third and fourth horizontal members thereby gripping the diving board between the first and third horizontal members and the second and fourth horizontal members, respectively.

8. The basketball hoop mounting apparatus of claim 4, wherein the first upright member is welded to the first horizontal member and the second horizontal member.

9. The basketball hoop mounting apparatus of claim 8, wherein the second upright member is welded to the first horizontal member and the second horizontal member.

* * * * *